US010584543B2

(12) United States Patent
Lastra

(10) Patent No.: US 10,584,543 B2
(45) Date of Patent: Mar. 10, 2020

(54) SUBSURFACE HANGER FOR UMBILICAL DEPLOYED ELECTRICAL SUBMERSIBLE PUMP

(71) Applicant: Saudi Arabian Oil Company, Dhahran (SA)

(72) Inventor: Rafael Adolfo Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 245 days.

(21) Appl. No.: 15/857,048

(22) Filed: Dec. 28, 2017

(65) Prior Publication Data

US 2018/0187493 A1 Jul. 5, 2018

Related U.S. Application Data

(60) Provisional application No. 62/441,635, filed on Jan. 3, 2017.

(51) Int. Cl.

| | |
|---|---|
| ***E21B 17/02*** | (2006.01) |
| ***E21B 43/12*** | (2006.01) |
| ***E21B 33/04*** | (2006.01) |
| ***E21B 23/01*** | (2006.01) |

(52) U.S. Cl.

CPC ..... *E21B 17/028* (2013.01); *E21B 23/01* (2013.01); *E21B 33/0407* (2013.01); *E21B 43/128* (2013.01)

(58) Field of Classification Search

CPC .. E21B 17/028; E21B 43/128; E21B 33/0407; E21B 17/023

See application file for complete search history.

(56) References Cited

U.S. PATENT DOCUMENTS 3,054,022 A * 9/1962 Baker ..... F04D 13/10 361/679.01
3,373,819 A * 3/1968 Baker ..... E21B 33/00 166/85.2
3,638,732 A * 2/1972 Huntsinger ..... E21B 17/023 166/379

(Continued)

FOREIGN PATENT DOCUMENTS

GB 2062368 A 5/1981
WO 2012166638 A2 12/2012

OTHER PUBLICATIONS

International Search Report and Written Opinion dated Apr. 5, 2018 for corresponding PCT/US2018/012146.

*Primary Examiner* — Shane Bomar
(74) *Attorney, Agent, or Firm* — Bracewell LLP; Constance G. Rhebergen; Linda L. Morgan

(57) ABSTRACT

A subsurface hanger apparatus for suspending an electrical submersible pump in subsurface tubing of a well includes a spool assembly having: a tubular shaped spool housing, a spool electrical pad, and a spool cable lead extending out of the spool housing. The apparatus also includes a hanger assembly having a cylindrical hanger housing, a hanger electrical pad, a hanger cable lead extending out of the hanger assembly in a direction opposite the spool cable lead, and a cable hanger sub circumscribing the hanger cable lead. The hanger electrical pad is positioned to engage the spool electrical pad when the hanger assembly is landed within, and supported by, the spool assembly.

19 Claims, 7 Drawing Sheets

(56) References Cited

U.S. PATENT DOCUMENTS

| | | | | |
|---|---|---|---|---|
| 4,304,452 | A * | 12/1981 | Kiefer | H01R 13/523 439/199 |
| 4,621,689 | A | 11/1986 | Brookbank | |
| 6,123,561 | A * | 9/2000 | Turner | E21B 17/028 439/194 |
| 6,200,152 | B1 * | 3/2001 | Hopper | E21B 33/03 439/310 |
| 6,398,583 | B1 * | 6/2002 | Zehren | E21B 17/023 439/205 |
| 8,813,839 | B2 | 8/2014 | Head | |
| 9,593,561 | B2 | 3/2017 | Xiao et al. | |
| 2011/0300008 | A1 | 12/2011 | Fielder et al. | |
| 2014/0048277 | A1 | 2/2014 | June et al. | |
| 2015/0330194 | A1 | 11/2015 | June et al. | |
| 2015/0354308 | A1 | 12/2015 | June et al. | |
| 2016/0076330 | A1 | 3/2016 | Roth et al. | |
| 2017/0175476 | A1 * | 6/2017 | Painter | E21B 33/0385 |
| 2017/0328186 | A1 * | 11/2017 | Bennett | E21B 43/128 |
| 2018/0066479 | A1 * | 3/2018 | Head | E21B 33/0407 |

* cited by examiner

SUBSURFACE HANGER FOR UMBILICAL DEPLOYED ELECTRICAL SUBMERSIBLE PUMP

CROSS REFERENCE TO RELATED APPLICATION

This application claims priority to and the benefit of co-pending U.S. Provisional Application Ser. No. 62/441,635, filed Jan. 3, 2017, titled "Subsurface Hanger For Umbilical Deployed Electrical Submersible Pump," the full disclosure of which is incorporated herein by reference in its entirety for all purposes.

BACKGROUND OF THE DISCLOSURE

1. Field of the Disclosure

The disclosure relates generally to electric submersible pump cables, and more particularly to suspending umbilical deployed electrical submersible pumps subsurface.

2. Description of the Related Art

Electrical submersible pumping ("ESP") systems are deployed in some hydrocarbon producing wellbores to provide artificial lift to deliver fluids to the surface. The fluids can be made up of liquid hydrocarbon, hydrocarbon gas, and water. When installed, a common electrical submersible pump system is suspended in the wellbore at the bottom of a string of production tubing. In addition to a pump, electrical submersible pump systems usually include an electrically powered motor and seal section. The pumps are often one of a centrifugal pump or positive displacement pump. When the electrical submersible pump fails, workover rigs are used to pull out the tubing and replace the failed electrical submersible pump. Workover rigs are costly, especially offshore. Also, waiting time for rigs can be as long as 6-12 months, leading to significant production deferral.

Technologies are being developed to allow for rig-less deployment of electrical submersible pumps inside the production tubing with the umbilical. When an electrical submersible pump fails, coiled tubing or a wireline unit can be used to pull out and replace the failed electrical submersible pump, leaving production tubing in place. The umbilical can have sufficient mechanical strength to carry the weight of the cable itself as well as the electrical submersible pump system, and also have the strength to handle the pull forces for system retrieval.

The umbilical of the electrical submersible pump can be hung at the wellhead. However, such currently available methods require the use of specialized electrical connectors and hangers to secure the umbilical to the wellhead and to provide power to the umbilical. The existing umbilical hangers are costly, bulky and require in most of the cases pressure compensation. In addition, current solutions are designed to fit horizontal wellhead trees only and there are no commercial solutions for vertical wellhead trees. Some conceptual solutions developed for vertical wellhead trees require the use of a separate wellhead spool below the master valve which allows the installation of a side exit penetrator to provide power for the pump.

SUMMARY OF THE DISCLOSURE

Embodiments of the current disclosure provide systems and methods that eliminate the dependency of rigs to install and replace an electrical submersible pump. This will allow the replacement of electrical submersible pumps with the use quicker and more agile winch type intervention units, saving operators in work over costs. Systems and method described provide both the ability to hang the electrical submersible pump below the surface without the need of a surface umbilical hanger and to connect the electrical submersible pump umbilical to the surface to provide electrical power, hydraulic power or instrumentation connections, such as instrumentation connections for sensors. Because no modification or add-ons are required to a common commercially available wellhead tree, the embodiments of this disclosure provide seamless ability to install electrical submersible pumps in wells equipped with either vertical or horizontal wellheads. In addition, systems and methods described allow for the installation of standard shallow subsurface safety valves, which is not possible with some current umbilical electrical submersible pump systems.

In an embodiment of this disclosure a subsurface hanger apparatus for suspending an electrical submersible pump in subsurface tubing of a well includes a spool assembly, the spool assembly having: a tubular shaped spool housing, a spool electrical pad, and a spool cable lead extending out of the spool housing. The apparatus also has a hanger assembly, the hanger assembly having: a cylindrical hanger housing, a hanger electrical pad, a hanger cable lead extending out of the hanger assembly in a direction opposite the spool cable lead, and a cable hanger sub circumscribing the hanger cable lead. The hanger electrical pad is positioned to engage the spool electrical pad when the hanger assembly is landed within, and supported by, the spool assembly.

In alternate embodiments, the apparatus can include a tubular shaped spool body, and the tubular shaped spool housing can be sized to circumscribe the spool body. A profile on an inner diameter of the spool assembly can have a reduced inner diameter that is smaller than an outer diameter of the hanger assembly. The hanger electrical pad can be moveable radially between a retracted position and an extended position, where in the extended position the hanger electrical pad is located to engage the spool electrical pad and prevent axial motion of the hanger assembly relative to the spool assembly.

In other alternate embodiments, the apparatus can include spool connector rings, the spool connector rings being arc-shaped members electrically connected between the spool electrical pad and the spool cable lead. The hanger cable lead can electrically connect the hanger electrical pad to an umbilical of the electrical submersible pump. The spool electrical pad can be a ring shaped member or can include three separate arc-shaped segments spaced circumferentially apart. The arc-shaped segments can be spaced axially apart.

In an alternate embodiment of this disclosure, a system for producing fluids from the well with the subsurface hanger apparatus includes the electrical submersible pump located within the well, the electrical submersible pump suspended by an umbilical. The spool assembly is secured in series with production tubing a distance below a wellhead assembly located at a surface. The hanger assembly is secured to the umbilical, where the hanger cable lead is in communication with the electrical submersible pump through the umbilical and the hanger assembly is secured to a top end of the umbilical.

In alternate embodiments, a cable can extend outside of the production tubing from the wellhead assembly to the spool cable lead. The distance below the wellhead assembly can be in a range of 100 to 500 feet. An upward facing shoulder can be on an inner diameter of the spool assembly, sized to engage a downward facing shoulder on an outer diameter of the hanger assembly and transfer a load of the electrical submersible pump and the umbilical from the hanger assembly to the spool assembly. The hanger electrical pad can be moveable radially between a retracted position and an extended position, where in the extended position the hanger electrical pad is located to engage the spool electrical pad to provide communication between the electrical submersible pump and the surface. The hanger assembly can further include a subsurface safety valve moveable from an open position to a closed position to prevent the fluids from passing through the hanger assembly.

In another alternate embodiment of this disclosure, a method for suspending an electrical submersible pump in a well with a subsurface hanger apparatus includes securing a spool assembly in series with production tubing of the well a distance below a wellhead assembly located at a surface, the spool assembly having a tubular shaped spool housing, a spool electrical pad, and a spool cable lead extending out of the spool housing. A hanger assembly is secured to a top end of an umbilical of the electrical submersible pump, the hanger assembly having a cylindrical hanger housing, a hanger electrical pad, a hanger cable lead extending out of the hanger assembly in a direction opposite the spool cable lead and in communication with the electrical submersible pump through the umbilical, and a cable hanger circumscribing the hanger cable lead. The electrical submersible pump is lowered into the well with the umbilical until the hanger assembly is landed within, and supported by, the spool assembly. The hanger electrical pad engages the spool electrical pad when the hanger assembly is landed within, and supported by, the spool assembly.

In alternate embodiments, lowering the electrical submersible pump into the well with the umbilical until the hanger assembly is landed within, and supported by, the spool assembly includes engaging an upward facing shoulder on an inner diameter of the spool assembly, with a downward facing shoulder on an outer diameter of the hanger assembly to transfer a load of the electrical submersible pump and the umbilical from the hanger assembly to the spool assembly. The hanger electrical pad can be moved radially from a retracted position to an extended position, where in the extended position the hanger electrical pad engages the spool electrical pad to provide communication between the electrical submersible pump and the surface and prevents axial motion of the hanger assembly relative to the spool assembly.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The inventive subject matter is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
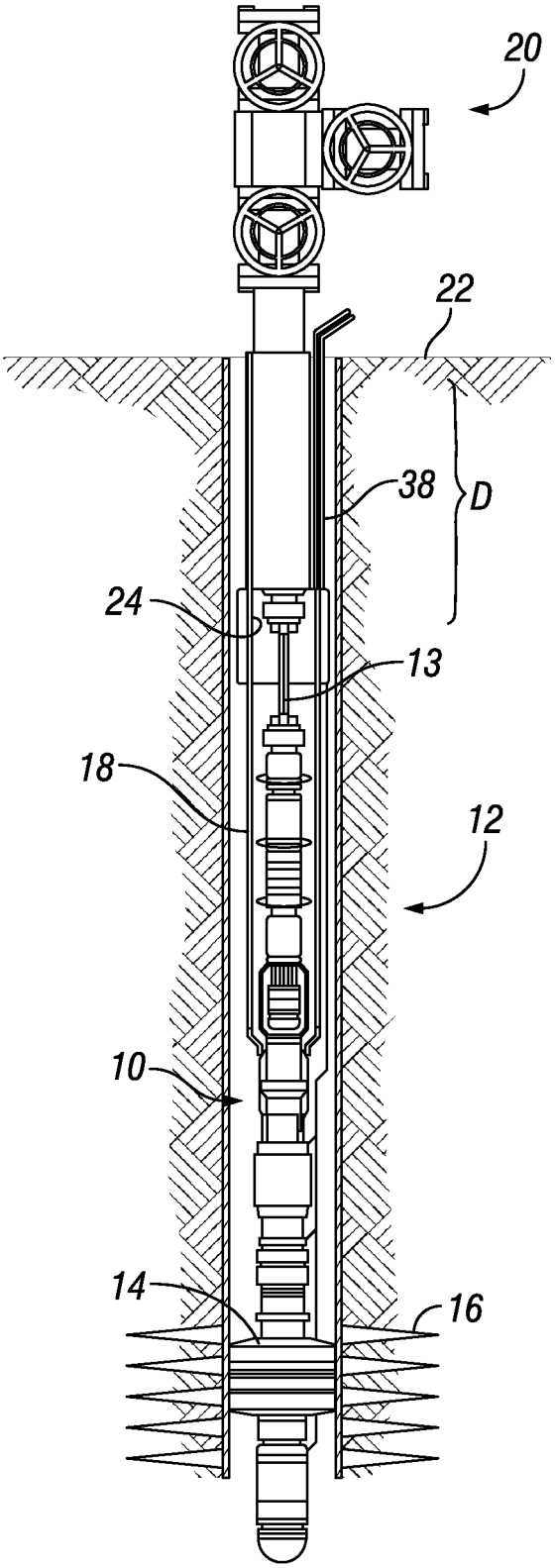
FIG. 1 is a section view of a subterranean well with a subsurface hanger apparatus, in accordance with an embodiment of this disclosure.

Looking at FIG. 1, electrical submersible pump system 10 is located within a bore of subterranean well 12. Electrical submersible pump system 10 can include traditional known components such as a pump, motor and seal section. Electrical submersible pump system 10 is an umbilical deployed electrical submersible pump system. In an umbilical deployed electrical submersible pump system, the electrical submersible pump system 10 is lowered into well 12 on umbilical 13 so that a winch type unit can install and remove electrical submersible pump system 10 and an expensive rig is not requires for such operations. Umbilical 13 can have sufficient mechanical strength to carry the weight of the umbilical 13 as well as the electrical submersible pump system 10, and can also withstand the pull forces required to retrieve electrical submersible pump system 10. Umbilical 13 can provide electrical power, hydraulic power, or instrumentation connection between the surface and electrical submersible pump system 10.

A packer 14 can seal within the bore of subterranean well 12 adjacent to perforations 16 that extend into a hydrocarbon formation. Electrical submersible pump system 10 can discharge fluids into production tubing 18 that extends into well 12. Production tubing 18 can deliver produced fluids to a wellhead assembly 20 located at the surface 22. Wellhead assembly 20 can have a vertical or horizontal tree. In the example embodiment of FIG. 1, wellhead assembly 20 is shown with standard, commercially available vertical tree.

Subsurface hanger apparatus 24 seamlessly provides both electrical and mechanical interfaces for umbilical 13. Subsurface hanger apparatus 24 conveys power and communication between the surface and electrical submersible pump system 10 and also transfers the loads of electrical submersible pump system 10 and umbilical 13 itself to production tubing 18.

Figure 2:
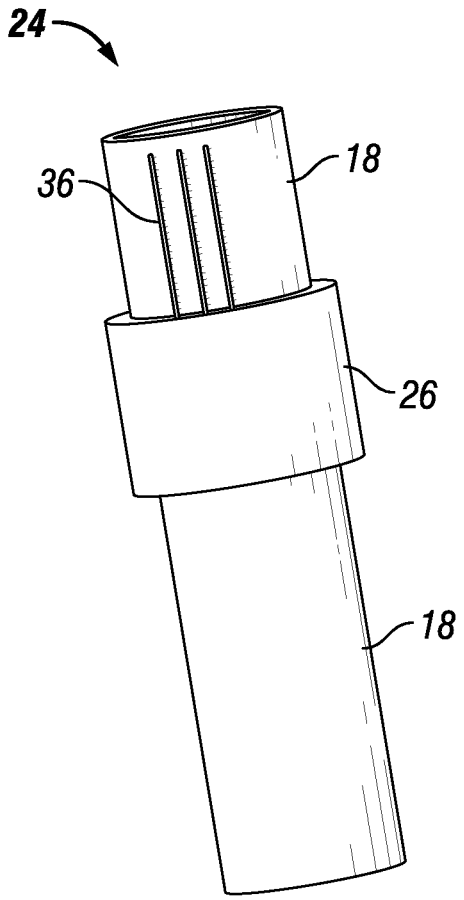
FIG. 2 is a perspective view of a subsurface hanger apparatus, in accordance with an embodiment of this disclosure.
Figure 3:
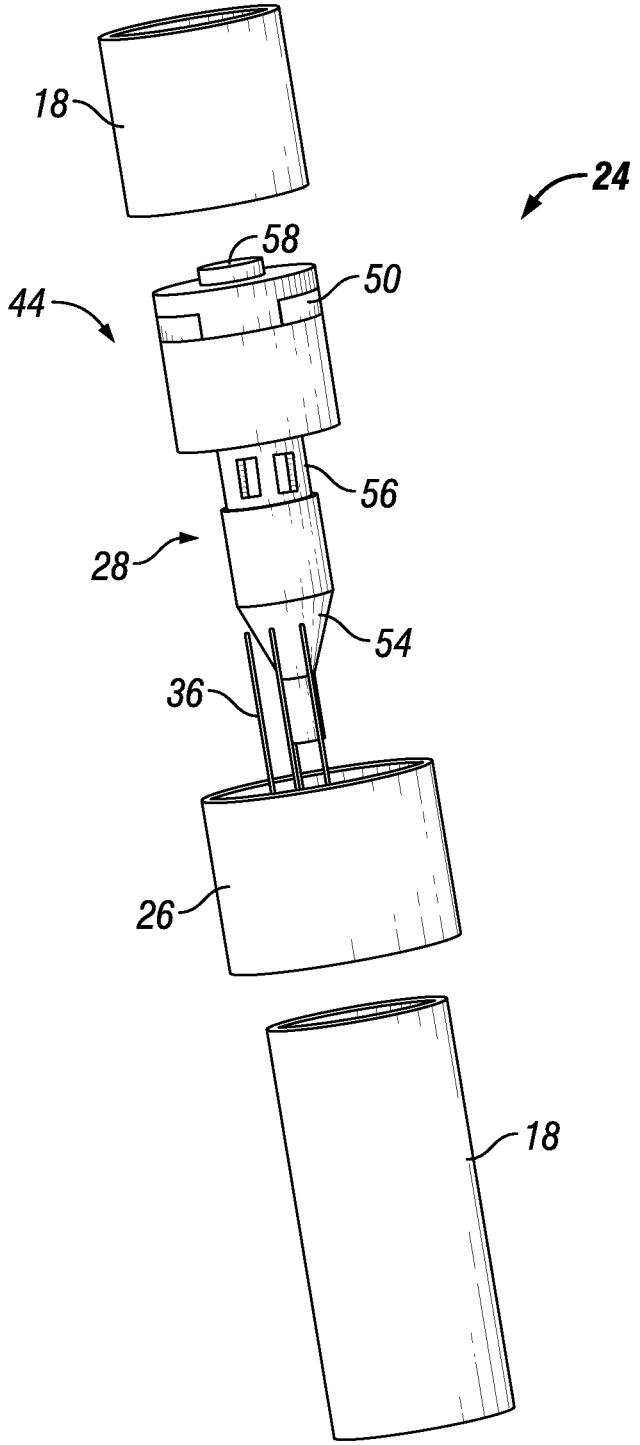
FIG. 3 is an exploded perspective view of the subsurface hanger apparatus of FIG. 2.

Looking at FIGS. 2-3, subsurface hanger apparatus 24 had two main parts; a fixed spool assembly 26 and a hanger assembly 28 that lands within the spool assembly 26. Spool assembly 26 is secured in series with production tubing 18 so that a portion of production tubing 18 is axially below spool assembly 26 and a portion of production tubing 18 is axially above spool assembly 26. Spool assembly 26 can be secured to production tubing 18 so that when installed in well 12, spool assembly 26 is a distance D, as shown in FIG. 1, below surface 22. In certain embodiments, distance D can be, for example in a range of 100-500 feet. In other embodiments, distance D can be, for example in a range of 300-400 feet. In yet other embodiments, distance D can be less than 100 feet or greater than 500 feet. Spool assembly 26 is deployed into well 12 with production tubing 18.

Figure 4:
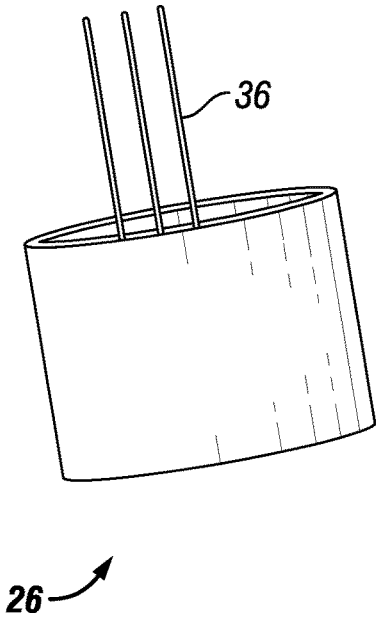
FIG. 4 is a perspective view of a spool assembly of a subsurface hanger apparatus, in accordance with an embodiment of this disclosure.
Figure 5:
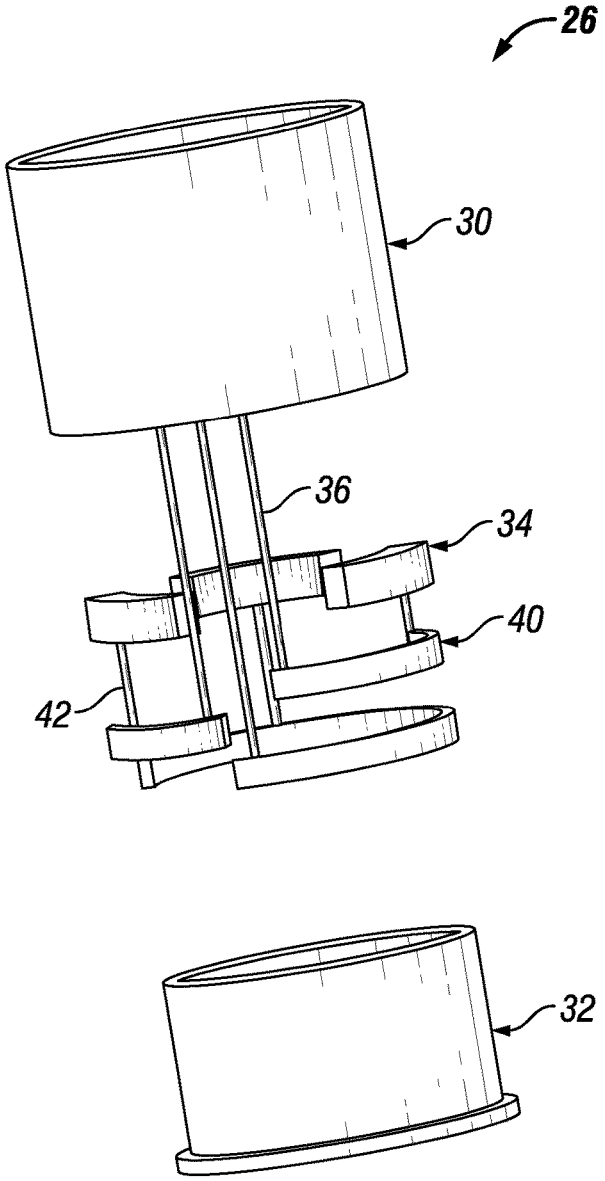
FIG. 5 is an exploded perspective view of the spool assembly of FIG. 4.

Looking at FIGS. 4-5, spool assembly 26 has tubular shaped spool housing 30 and tubular shaped spool body 32. Tubular shaped spool housing 30 is sized to circumscribe spool body 32 so that a portion of spool body 32 is located within spool housing 30. Spool housing 30 mates with spool body 32 to house the internal components of spool assembly 26.

Figure 9:
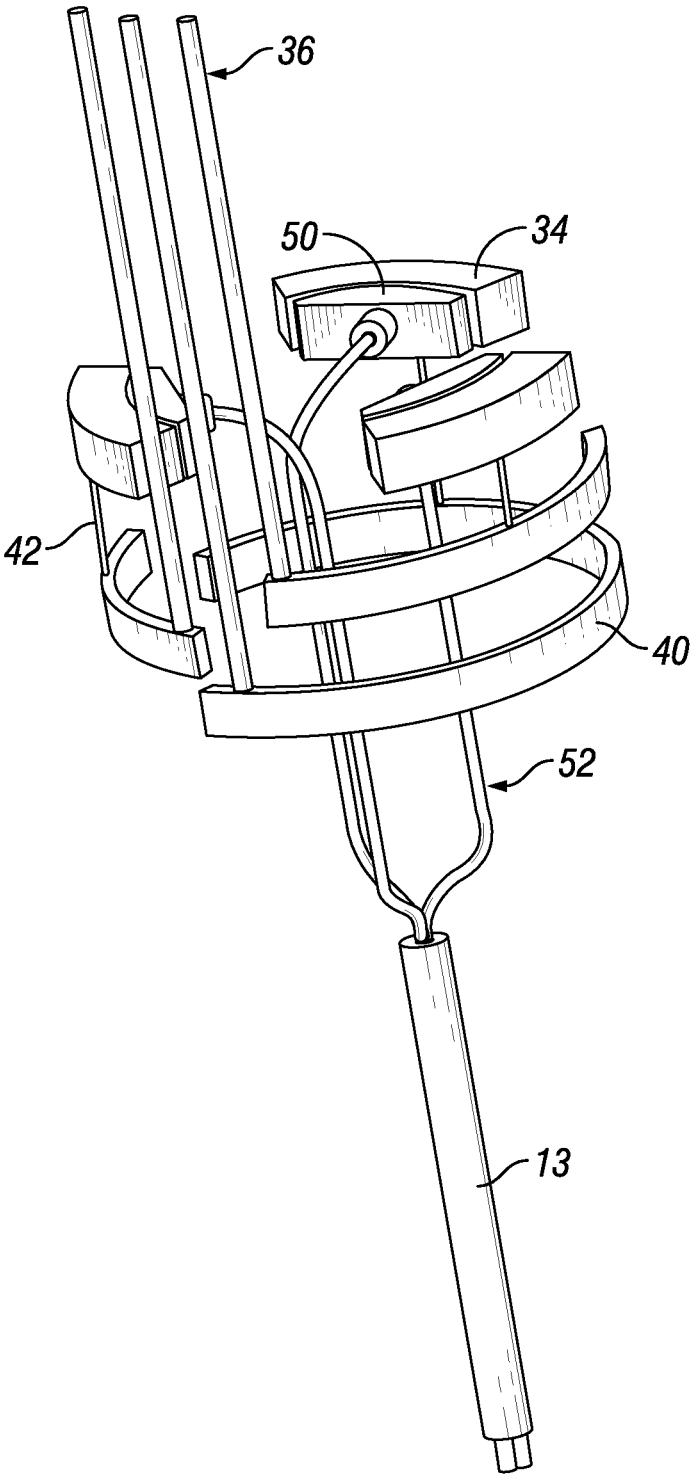
FIG. 9 is a perspective view of a portion of a subsurface hanger apparatus, in accordance with an embodiment of this disclosure.
Figure 10:
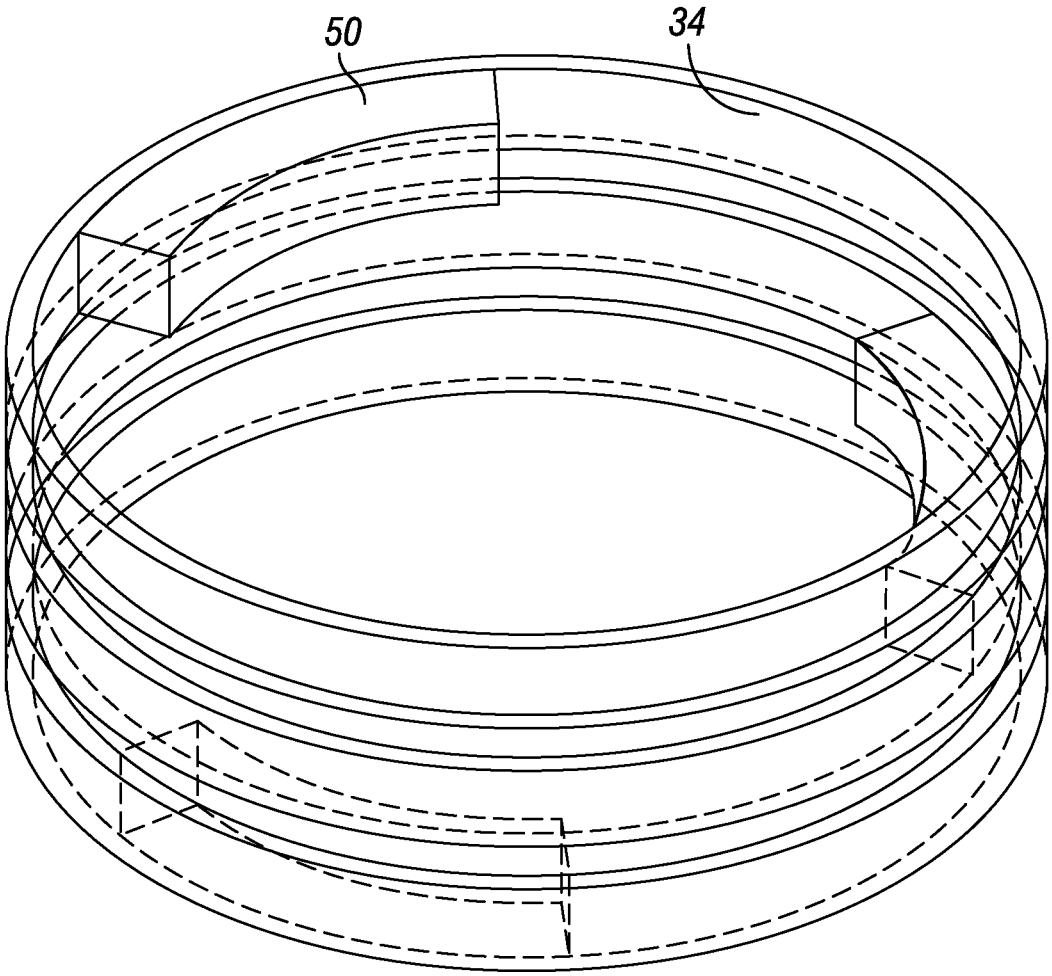
FIG. 10 is a perspective view of a portion of a subsurface hanger apparatus, in accordance with an embodiment of this disclosure.

Spool electrical pad 34 is located within spool housing 30. Spool electrical pad 34 is formed of conductive material for conveying power and communications signals. In the embodiment of FIGS. 5 and 9, there are three separate arc-shaped segments that make up the spool electrical pads 34. The three spool electrical pads 34 of FIGS. 5 and 9 are spaced circumferentially apart and are axially aligned. In the embodiment of FIG. 10, three ring shaped members make up the spool electrical pads 34. The ring shaped spool electrical pads 34 of FIG. 10 are spaced axially apart. In alternate embodiments, there can be a minimum of one spool electrical pad 34 or more than three spool electrical pads 34, depending on the number of individual connections required or desired to monitor and control electrical submersible pump system 10.

Spool cable lead 36, as shown previously in FIGS. 2-3, extends out of spool housing 30. In the example of FIG. 5, there are three spool cable leads 36. In alternate embodiments, there can be a minimum of one spool cable lead 36 or more than three spool cable leads 36, depending on the number of individual connections required or desired to monitor and control electrical submersible pump system 10. Spool cable lead 36 extends in a direction out of well 12. Spool cable lead 36 can convey power and communication between systems at the surface 22 and electrical submersible pump system 10 located within well 12. Spool cable lead 36 is connected to systems at surface 22 by a length of cable 38 (shown also in FIG. 1) that extends parallel to production tubing 18 in a tubing casing annulus that is located between an outside of tubing 18 and an inner bore surface of well 12. In addition to at least one electrical conductor, cable 38 can also include hydraulic, sensor, or other communication lines. Cable 38 can be installed with tubing 18. Standard wellhead penetrators and surface connectors known in the art can be used to complete the circuits.

Looking at FIG. 5, spool connector ring 40 and can provide a path for electrical or other communication signal between spool electrical pad 34 and spool cable lead 36. Spool connector rings can be arc-shaped members that extend radially between spool electrical pad 34 and spool cable lead 36. Vertical connector members 42 complete the path axially between spool electrical pad 34 and spool cable lead 36. In the embodiment of FIG. 5, the number of spool electrical pads 34 is equal to the number of spool cable leads 36 and each spool electrical pad 34 is separately connected to an individual spool cable lead 36. In alternate embodiments, other suitable connector means and connection patterns can be used to provide path for electrical or other communication signal between spool electrical pad 34 and spool cable lead 36.

Figure 8:
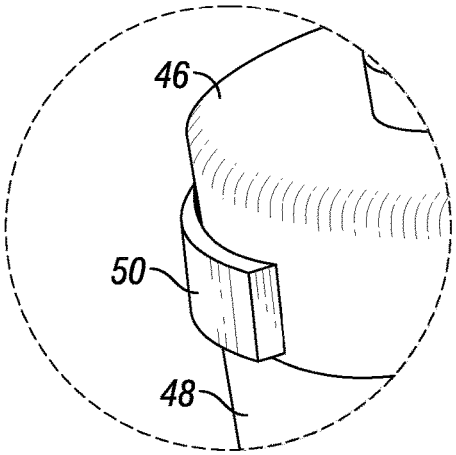
FIG. 8 is a detail view of the hanger assembly of FIG. 6, showing the hanger electrical pad in the extended position.
Figure 6:
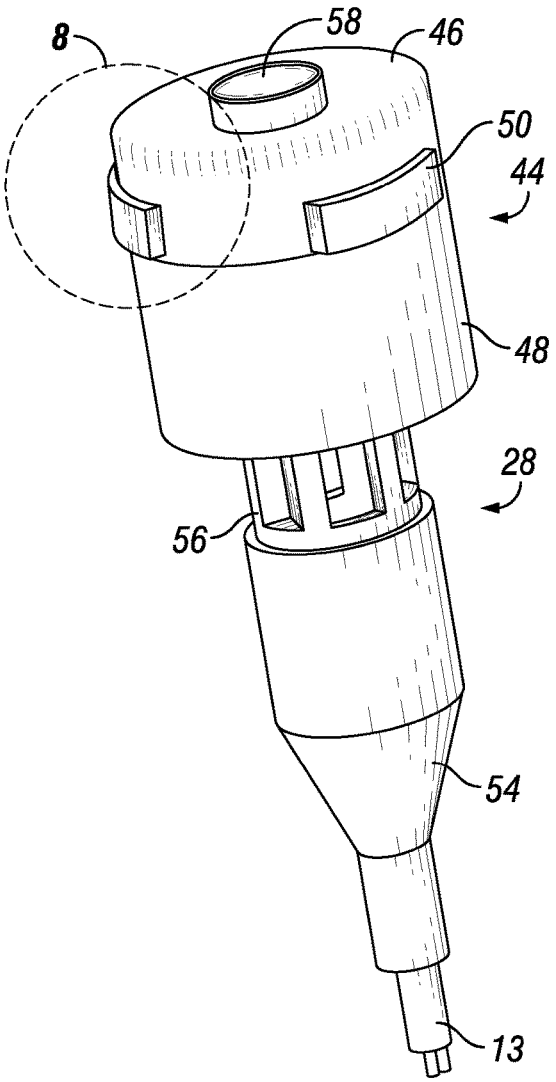
FIG. 6 is a perspective view of a hanger assembly of a subsurface hanger apparatus, in accordance with an embodiment of this disclosure.

Looking at FIGS. 6 and 8, hanger assembly 28 includes a cylindrical hanger housing 44. Hanger housing 44 has hanger housing top 46 and hanger housing bottom 48. Hanger housing 44 has an interior space for containing the internal components of hanger assembly 28.

Figure 7:
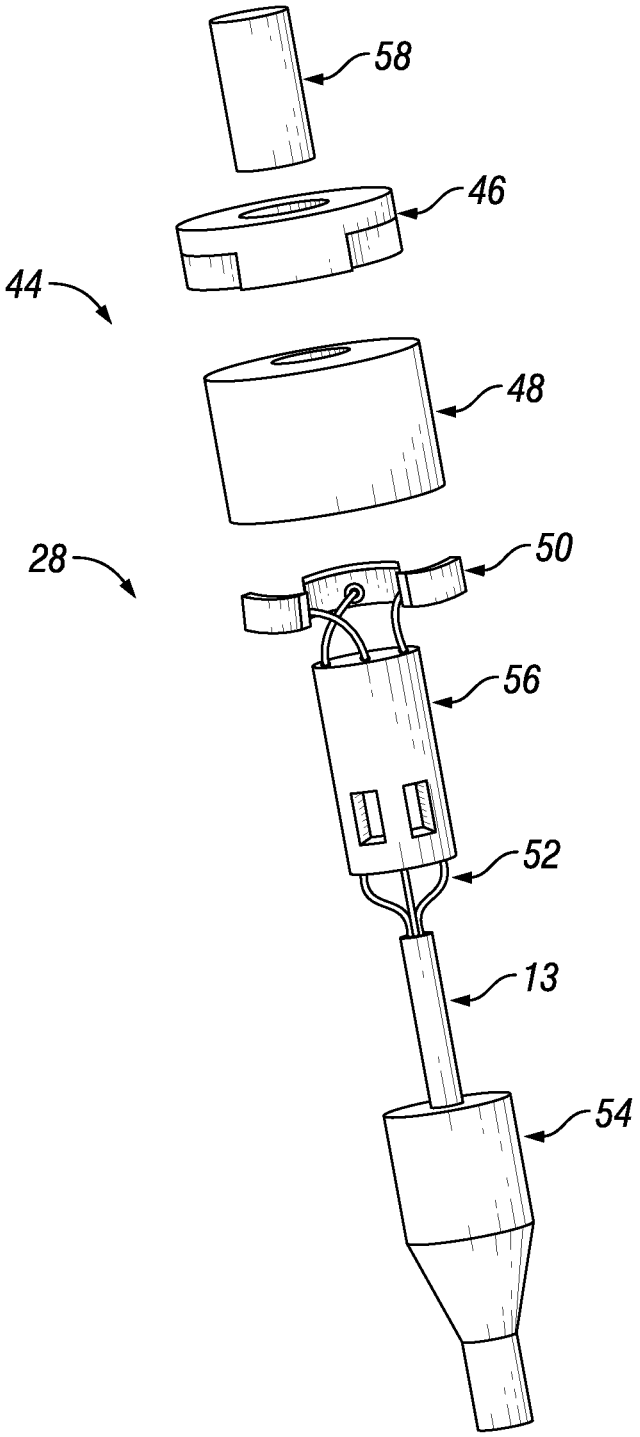
FIG. 7 is an exploded perspective view of the hanger assembly of FIG. 6.

Hanger electrical pad 50 is located within hanger housing 44 both first shown in FIG. 3. Hanger electrical pad 50 is formed of conductive material for conveying power and communications signals. In the embodiment of FIGS. 6-7 and 9-10, there are three separate arc-shaped segments that make up the hanger electrical pads 50. The three hanger electrical pads of FIGS. 6-7 and 9 are spaced circumferentially apart and are axially aligned. In the embodiment of FIG. 10, the three hanger electrical pads are spaced circumferentially apart and spaced axially apart. In alternate embodiments, there can be a minimum of one hanger electrical pad 50 or more than three hanger electrical pads 50, depending on the number of individual connections required or desired to monitor and control electrical submersible pump system 10.

Hanger electrical pad 50 is positioned to engage spool electrical pad 34 when hanger assembly 28 is landed within, and supported by, spool assembly 26 to provide communication between electrical submersible pump system 10 and the surface. Hanger electrical pad 50 can be moveable radially between a retracted position (FIG. 3) and an extended position (FIG. 8). In the retracted position, hanger electrical pad 50 can have an outer surface that is flush with or recessed within an outer diameter of hanger housing 44. In the extended position hanger electrical pad 50 is located to engage spool electrical pad 34 and can prevent axial motion of hanger assembly 28 relative to spool assembly 26.

In the extended position, hanger electrical pad 50 has moved radially outward and the outer surface of hanger electrical pad 50 is radially outward of the outer diameter of hanger housing 44. In the example of FIG. 8, hanger electrical pad 50 has passed through openings in hanger housing top 46. Looking at FIG. 9, in the extended position, the outer surface of hanger electrical pad 50 has moved radially outward a sufficient distance to engage spool electrical pad 34. In order to engage spool electrical pad 34, hanger electrical pad 50 can first be rotationally aligned with spool electrical pad 34 before moving to the extended position. Hanger electrical pad 50 can be actuated to be moved to the extended position electrically, hydraulically or manually. In order for hanger electrical pad 50 to be rotationally aligned with spool electrical pad 34, spool assembly 26 can have an auto-rotation feature known in the art to assure the correct alignment. Alternately, in the embodiment of FIG. 10, where three ring shaped members make up the spool electrical pads 34, there is no need for rotational alignment between hanger electrical pad 50 and spool electrical pad 34 since spool electrical pad 34 extends entirely around a circumference of spool assembly 26.

In order to prevent axial motion of hanger assembly 28 relative to spool assembly 26, in the extended position, hanger electrical pad 50 can engage a groove or other recess of spool assembly 26. Spool electrical pad 34 can be located in such a grove or recces of spool assembly 26 so that as hanger electrical pad 50 moves into the groove or recesses of spool assembly 26, a connection is made between hanger electrical pad 50 and spool electrical pad 34. In certain embodiments the groove or recess of spool assembly 26 can be shaped to limit both relative axial and rotational movement of hanger assembly 28 relative to spool assembly 26.

Looking at FIGS. 7 and 9, hanger cable lead 52 extends out of hanger assembly 28 in a direction opposite the direction of spool cable lead 36. The number of hanger cable leads 52 can be the same as the number of hanger electrical pads 50 and each hanger cable lead 52 can be directly connection to a separate hanger electrical pad 50. Hanger cable lead 52 can provide an electrical and other signal connection between hanger electrical pad 50 and umbilical 13 of electrical submersible pump system 10. In this way, hanger cable lead 52 is in communication with electrical submersible pump system 10 through umbilical 13. Preferably, hanger cable lead 52 can be an end of a communications line of umbilical 13 that is un-spliced in order to reduce the overall number of splices in the communications systems. Alternately cable lead 52 can be spliced to a communication line of umbilical 13.

Hanger assembly 28 is secured to a top end of umbilical 13 with cable hanger 54 that circumscribes umbilical 13 and hanger cable lead 52. Cable hanger 54 is an attachable and detachable component that can connect to the load bearing member of umbilical 13 so that hanger assembly 28 takes on the load of cable hanger 54 and electrical submersible pump system 10 without damaging any communication lines within umbilical 13. In certain embodiments, each of the communication connections of subsurface hanger apparatus 24 can be protected from the downhole fluids using sliding gates that open during the mating of hanger assembly 28 with spool assembly 26, and then close when they are detached. Wipers be also be used to clean the connections as needed.

In order to arrive at a correct axial alignment of hanger assembly 28 relative to spool assembly 26, and to covert the load of, an upward facing shoulder on an inner diameter of spool assembly 26 can be sized to engage a downward facing shoulder on an outer diameter of hanger assembly 28. When installing electrical submersible pump system 10 into well 12, electrical submersible pump assembly 10 can be lowered until hanger assembly 28 is landed within and supported by spool assembly 26 through the interaction of the upward facing shoulder of spool assembly 26 and the downward facing shoulder of hanger assembly 28. The upward facing shoulder of spool assembly 26 and the downward facing shoulder of hanger assembly 28 can be, for example, a no-go profile.

Looking at FIGS. 3, 6 and 7, in certain embodiments, hanger assembly 28 sealingly engages spool assembly 26 and a fluid flow path through subsurface hanger apparatus 24 is provided by way of fluid crossover tube 56 and insert tube 58. A bottom end of insert tube 58 is aligned with the bore of fluid crossover tube 56. Fluid below subsurface hanger apparatus 24 can enter subsurface hanger apparatus 24 through openings in fluid crossover tube 56, pass into insert tube 58, and exit a top end of insert tube 58 above subsurface hanger apparatus 24.

In certain embodiments, in order to provide emergency closure of the producing conduits, a subsurface safety valve can be located within insert tube 58.

Embodiments of this disclosure provide systems and methods that that do not require pressure compensation and allow for the use of off-the-shelf electrical well head penetrators and standard tubing hangers for the installation of the umbilical deployed electrical submersible pump assembly, eliminating the need of installing additional spools at the wellhead.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A subsurface hanger apparatus for suspending an electrical submersible pump in subsurface tubing of a well, the apparatus including:

a spool assembly, the spool assembly having:
- a tubular shaped spool housing,
- a spool electrical pad, and
- a spool cable lead extending out of the spool housing;

a hanger assembly, the hanger assembly having:
- a cylindrical hanger housing,
- a hanger electrical pad,
- a hanger cable lead extending out of the hanger assembly in a direction opposite the spool cable lead, and
- a cable hanger sub circumscribing the hanger cable lead; where the hanger electrical pad is positioned to engage the spool electrical pad when the hanger assembly is landed within, and supported by, the spool assembly.

2. The apparatus of claim 1, further comprising a tubular shaped spool body, where the tubular shaped spool housing is sized to circumscribe the spool body.

3. The apparatus of claim 1, further comprising a profile on an inner diameter of the spool assembly, the profile having a reduced inner diameter that is smaller than an outer diameter of the hanger assembly.

4. The apparatus of claim 1, where the hanger electrical pad is moveable radially between a retracted position and an extended position, where in the extended position the hanger electrical pad is located to engage the spool electrical pad and prevent axial motion of the hanger assembly relative to the spool assembly.

5. The apparatus of claim 1, further comprising spool connector rings, the spool connector rings being arc-shaped members electrically connected between the spool electrical pad and the spool cable lead.

6. The apparatus of claim 1, where the hanger cable lead electrically connects the hanger electrical pad to an umbilical of the electrical submersible pump.

7. The apparatus of claim 1, where the spool electrical pad is a ring shaped member.

8. The apparatus of claim 1, where the spool electrical pad includes three separate arc-shaped segments spaced circumferentially apart.

9. The apparatus of claim 8, where the arc-shaped segments are spaced axially apart.

10. A system for producing fluids from the well with the subsurface hanger apparatus of claim 1, the system including:

the electrical submersible pump located within the well, the electrical submersible pump suspended by an umbilical; where the spool assembly is secured in series with production tubing a distance below a wellhead assembly located at a surface; and the hanger assembly is secured to the umbilical, where the hanger cable lead is in communication with the electrical submersible pump through the umbilical and the hanger assembly is secured to a top end of the umbilical.

11. The system of claim 10, further including a cable extending outside of the production tubing from the wellhead assembly to the spool cable lead.

12. The system of claim 10, where the distance below the wellhead assembly is in a range of 100 to 500 feet.

13. The system of claim 10, further comprising an upward facing shoulder on an inner diameter of the spool assembly, sized to engage a downward facing shoulder on an outer diameter of the hanger assembly and transfer a load of the electrical submersible pump and the umbilical from the hanger assembly to the spool assembly.

14. The system of claim 10, where the hanger electrical pad is moveable radially between a retracted position and an extended position, where in the extended position the hanger electrical pad is located to engage the spool electrical pad to provide communication between the electrical submersible pump and the surface.

15. The system of claim 10, where the hanger assembly further includes a subsurface safety valve moveable from an open position to a closed position to prevent the fluids from passing through the hanger assembly.

16. A method for suspending an electrical submersible pump in a well with a subsurface hanger apparatus, the method including:

securing a spool assembly in series with production tubing of the well a distance below a surface wellhead assembly located at a surface, the spool assembly having a tubular shaped spool housing, a spool electrical pad, and a spool cable lead extending out of the spool housing;

securing a hanger assembly to a top end of an umbilical of the electrical submersible pump, the hanger assembly having a cylindrical hanger housing, a hanger electrical pad, a hanger cable lead extending out of the hanger assembly in a direction opposite the spool cable lead and in communication with the electrical submersible pump through the umbilical, and a cable hanger circumscribing the hanger cable lead;

lowering the electrical submersible pump into the well with the umbilical until the hanger assembly is landed within, and supported by, the spool assembly; where the hanger electrical pad engages the spool electrical pad when the hanger assembly is landed within, and supported by, the spool assembly.

17. The method of claim 16, where lowering the electrical submersible pump into the well with the umbilical until the hanger assembly is landed within, and supported by, the spool assembly includes engaging an upward facing shoulder on an inner diameter of the spool assembly, with a downward facing shoulder on an outer diameter of the hanger assembly to transfer a load of the electrical submersible pump and the umbilical from the hanger assembly to the spool assembly.

18. The method of claim 16, further including moving the hanger electrical pad radially from a retracted position to an extended position, where in the extended position the hanger electrical pad engages the spool electrical pad to provide communication between the electrical submersible pump and the surface.

19. The method of claim 16, further including moving the hanger electrical pad radially from a retracted position to an extended position, where in the extended position the hanger electrical pad prevents axial motion of the hanger assembly relative to the spool assembly.

* * * * *